United States Patent [19]

Kemeny et al.

[11] 4,355,561

[45] Oct. 26, 1982

[54] PROJECTILE LAUNCHING SYSTEM WITH ASSURED CURRENT DIVISION

[75] Inventors: George A. Kemeny, Wilkins Township, Allegheny County, Pa.; John P. Barber, Kettering, Ohio

[73] Assignee: Westinghouse Electric Corp., Pittsburgh, Pa.

[21] Appl. No.: 185,705

[22] Filed: Sep. 10, 1980

[51] Int. Cl.[3] ..... F41F 1/00

[52] U.S. Cl. ..... 89/8; 124/3

[58] Field of Search ..... 89/8; 124/3; 307/112, 307/139, 143; 318/135; 310/12-14, 302

[56] References Cited

U.S. PATENT DOCUMENTS 1,370,020 3/1921 Fauchon-Villepleé ..... 89/8

OTHER PUBLICATIONS

J. Appl. Phys. 49(4), (4/78), pp. 2540-2542, Rushleigh et al.

EP-T12, (3/72), The Acceleration of Macroparticles and a Hypervelocity Electromagnetic Accelerator, Barber, pp. 90-123, Australian National University.

*Primary Examiner*—Sal Cangialosi

*Attorney, Agent, or Firm*—F. J. Baehr, Jr.

[57] ABSTRACT

Series resistance is added to the projectile current loop to assure there will be no premature launching or excessive heating of the projectile armature during the energizing cycle.

12 Claims, 2 Drawing Figures

PROJECTILE LAUNCHING SYSTEM WITH ASSURED CURRENT DIVISION

CROSS-REFERENCE TO RELATED APPLICATIONS

An application entitled "A Switching System" filed by the assignee on Dec. 4, 1979 and assigned Ser. No. 100,302 provides a background for this invention and is hereby incorporated by reference. An application entitled "Projectile Launching System With Resistive Inserts In The Breech" is being filed concurrently herewith and is hereby incorporated by reference.

BACKGROUND OF THE INVENTION

This invention relates to electromagnetic projectile launching and more particularly to such a system in which there is assured current division prior to initiating launching.

A launching system utilizing two sets of parallel rails where one set of rails provides switching and the other pair of rails is utilized for launching the projectile and the rails in each pair are connected respectively to the rails in the other pair produce several advantages, as for example, once the current has been commutated to the launching rails, the switching armature no longer carries current and can be discharged from the switching rails or it can pass over an insulated portion of the rails eliminating the electromagnetic forces thereon thus greatly reducing the energy required to decelerate the switching armature. The problem with such a system is premature movement and heating of the projectile armature during the charging cycle.

SUMMARY OF THE INVENTION

In general an electromagnetic projectile launching system, when made in accordance with this invention, comprises a pair of conductive rails, means for conducting current between the rails and for propelling a projectile, a source of high current, means for commutating current from the current source to the rails, and a resistance disposed between the rails and the current source for limiting the flow of current to the rails prior to commutation of current thereto.

BRIEF DESCRIPTION OF THE DRAWINGS

The objects and advantages of this invention will become more apparent from reading the following detailed description in conjunction with the following drawings, in which.

DESCRIPTION OF THE PREFERRED EMBODIMENTS

Figure 1:
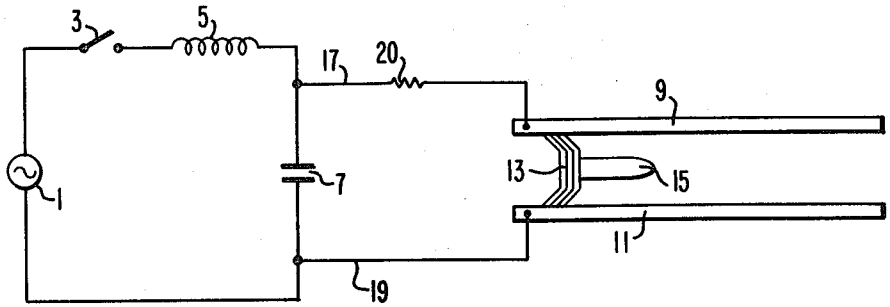
FIG. 1 is a schematic diagram of an electromagnetic launching system made in accordance with this invention.

Referring now to the drawings in detail and in particular to FIG. 1 there is shown a schematic diagram of an electromagnetic projectile launching system, which comprises a series circuit having a supply or source of high current such as a homopolar DC generator 1 or other generator means, a make switch 3, an induction coil or other inductive energy storage means, which may be the field generating coil of the generating means, and a circuit breaking means 7 or other means, which include semiconductors, which is capable of interrupting and commutating 1½ million amps. Also shown are a pair of conductive rails 9 and 11 with an armature 13 or other means for conducting current between the rails 9 and 11 and for accelerating a projectile 15 along the rails 9 and 11. Leads 17 and 19 connect the rails across the circuit breaking means 7 and a resistance 20 in the range of 30 micro-ohms is disposed in the lead 17 to prevent premature movement and excessive premature heating of the projectile armature 13 as the induction coil 5 is being energized.

Figure 2:
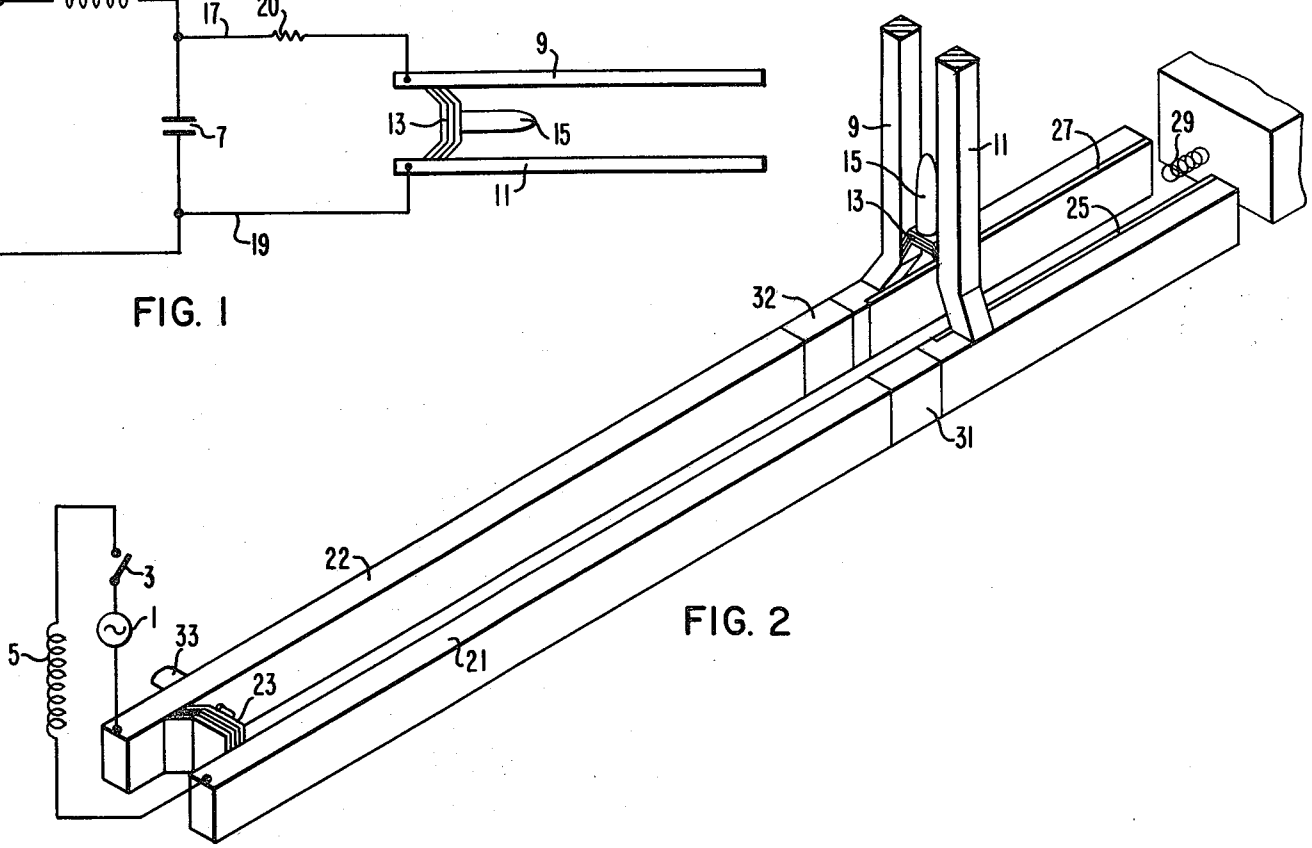
FIG. 2 is a schematic diagram of an alternative embodiment of the electromagnetic launching system.

The launching system shown in FIG. 2 is similar to the system shown in FIG. 1 and has a homopolar generator 1, which produces a high DC current that passes in series through the make switch 3 and the induction coil 5. The projectile 15 and projectile armature 13 are disposed between the parallel conductive rails 9 and 11. However, in FIG. 2 the circuit breaking means or commutating means comprises a second set of parallel conductive rails 21 and 22 having a switching armature 23 or other means (including an arc) for conducting a current between the rails 21 and 22. Insulating strips 25 and 27 are shown disposed on the trailing ends of the conductive rails 21 and 22. They are disposed between the switching armature 23 and the conductive rails 21 and 22 and an energy absorbing means 29 is disposed to stop the switching armature 23 at the trailing end of the switching rails 21 and 22. The trailing ends of the rails 21 and 22 could be made of non-conducting material rather than providing the insulating strips shown. The rails 21 and 22 each have a resistive portion 31 and 32 disposed adjacent the rails 9 and 11. The resistance of these portions of the conductive rails 21 and 22 in the preferred embodiment is approximately 30 micro-ohms and serves to prevent premature movement and heating of the projectile armature as the induction coil 5 is being energized. Means for releasably holding the switching armature 23 is disposed adjacent the leading end or breech end of the second pair of conductive rails 21 and 22 as indicated at 33 and holds the switching armature 23 in place as energy is being built up in the induction coil 5 and when desired releases the armature 23 to commutate current to the projectile rails 9 and 11.

The operation of the system is as follows:

The make switch 3 is closed and the homopolar generator 1 generates a current, which passes through the induction coil 5 and builds up to a predetermined level, which may be in the order of 1.5 million amps. In the FIG. 1 circuit the circuit breaking means 7 and in the FIG. 2 circuit the rails 21 and 22 and the switching armature 23 complete the series circuit. The resistance 20 in FIG. 1 or 31 and 32 in FIG. 2 prevent premature movement and excessive heating of the projectile armature 13 even though there is a completed electrical circuit therethrough during the period when the induction coil 5 is being energized and the switching armature 23 is being held in place by the releasable holding means 33 or the circuit breaker 7 is closed. The resistance of the circuit through the armature 23 or circuit breaker 7 may be approximately 0.3 micro-ohms. Adding sufficient resistance in the parallel circuit through the projectile armature 13 and conductive rails 9 to 11 absolutely assures that the parasitic projectile current passing through the projectile armature 13 during charging will not be excessive. Assume a circuit resistance through the projectile armature 13 of 30 micro-ohms. The low frequency induction coil energizing current will be divided in a ratio of approximately 100 to 1, that is, during the energizing period about 1% of the current will parasitically flow through the projectile armature 13. Assuming a fully energized current of 1½ million amps the maximum projectile accelerating force is about 100,000 pounds. At 1% of the current, since the force is proportional to the current squared, the maximum force on the projectile armature 13 and projectile 15 would be about 10 pounds of force. Ten pounds is expected to be below the force necessary to overcome the static friction. Assuming a five meter barrel during the launch and the characteristics of a suitably matched inductive energy storage, the launch velocity will only be reduced in the order of 1% by inclusion of about 30 microohm resistance. The resistor to have sufficient mass to absorb heat without excessively high temperature rises. The invention is shown with various switching devices to commutate the current from the source to the launching rails 9 and 11. In FIG. 1 the switching device is a circuit breaker or circuit breaking means 7, while in FIG. 2 the switching device is a pair of rails 21 and 22 and an armature 23 slidably disposed between the rails that serves as a switch or commutating device.

We claim:

1. An electromagnetic projectile launching system comprising:

a pair of conductive rails:

means for conducting current between said rails and for propelling a projectile from one end of said rails to another;

a source of high current;

means for commutating current from said current source to said rails connected to said rails in parallel with said means for conducting current and said means for propelling the projectile; and a resistance electrically connected between said current conducting and projectile propelling means and said means for commutating current for limiting the flow of current to said rails prior to the commutation of current to said rails and for carrying the full current during the entire launch.

2. An electromagnetic projectile launching system as set forth in claim 1, wherein the source of high current comprises an inductive energy storage means, a DC generator and a make switch.

3. An electromagnetic projectile launching system as set forth in claim 1, wherein the means for commutating current comprises a second pair of conductive rails electrically connected to said first mentioned pair of rails and an armature slidably disposed between said second pair of rails and a source of DC current connected to said second set of rails.

4. An electromagnetic projectile launching system as set forth in claim 3, wherein the resistance is disposed in at least one of the conductive rails of said second pair.

5. An electromagnetic projectile launching system as set forth in claim 3 wherein the resistance is disposed in the conductive rails of said second pair.

6. An electromagnetic projectile launching system as set forth in claim 3 and further comprising means for releasably holding the armature between said second pair of rails.

7. An electromagnetic projectile launching system as set forth in claim 3, wherein the second pair of conductive rails has at least one insulating strip disposed between a rail and the armature adjacent the attachment to the first pair of conductive rails.

8. An electromagnetic projectile launching system as set forth in claim 3, wherein the second pair of conductive rails has insulating strips disposed adjacent their trailing ends between the rail and the armature slidably disposed therein.

9. An electromagnetic projectile launching system as set forth in claim 3, wherein the source of high current comprises an inductive energy storage means and a DC generator.

10. An electromagnetic projectile launching system as set forth in claim 3 and further comprising means for decelerating the armature disposed between the second set of rails, the decelerating means being disposed at the trailing end of the second pair of rails.

11. An electromagnetic projectile launching system as set forth in claim 1, wherein the means for commutating current comprises circuit breaking means.

12. An electromagnetic projectile launching system as set forth in cliam 1, wherein the means for commutating current comprises semiconductors.

* * * * *